US008132833B2

(12) United States Patent
Schnekenburger

(10) Patent No.: US 8,132,833 B2
(45) Date of Patent: Mar. 13, 2012

(54) USE OF AN INTUMESCENT MATERIAL AND DEVICE HAVING A MATERIAL OF THIS TYPE

(75) Inventor: Rudolf Schnekenburger, Dellingen (DE)

(73) Assignee: Assa Alboy Sicherheitstechnik GmbH, Albstadt (DE)

( * ) Notice: Subject to any disclaimer, the term of this patent is extended or adjusted under 35 U.S.C. 154(b) by 902 days.

(21) Appl. No.: 10/574,658

(22) PCT Filed: Oct. 8, 2004

(86) PCT No.: PCT/EP2004/011306

§ 371 (c)(1),
(2), (4) Date: Dec. 29, 2006

(87) PCT Pub. No.: WO2005/036578

PCT Pub. Date: Apr. 21, 2005

(65) Prior Publication Data

US 2007/0132250 A1 Jun. 14, 2007

(30) Foreign Application Priority Data

Oct. 9, 2003 (DE) ..... 103 47 027

(51) Int. Cl.
*E05B 15/02* (2006.01)
*E05B 15/00* (2006.01)

(52) U.S. Cl. ..... 292/341.16

(58) Field of Classification Search ..... 252/606, 252/62; 292/341.16, DIG. 66, 1; 523/179
See application file for complete search history.

(56) References Cited

U.S. PATENT DOCUMENTS

| | | | | |
|---|---|---|---|---|
| 3,819,215 | A * | 6/1974 | Fuss | 292/201 |
| 4,007,954 | A * | 2/1977 | Erickson | 292/165 |
| 4,015,869 | A * | 4/1977 | Horvath | 292/341.16 |
| 4,161,804 | A * | 7/1979 | D'Hooge et al. | 16/48.5 |
| 4,183,565 | A * | 1/1980 | Allemann | 292/163 |
| 4,676,025 | A | 6/1987 | Rogers et al. | |
| 4,714,285 | A * | 12/1987 | Langham | 292/163 |
| 4,748,915 | A * | 6/1988 | Hastings et al. | 109/2 |
| 4,867,496 | A * | 9/1989 | Thomas | 292/341.16 |
| 5,121,950 | A * | 6/1992 | Davidian | 292/164 |
| 5,380,053 | A | 1/1995 | Saino | |
| 5,492,208 | A | 2/1996 | Goossens | |
| 5,816,017 | A * | 10/1998 | Hunt et al. | 52/784.11 |
| 5,924,750 | A * | 7/1999 | Fuss et al. | 292/201 |
| 6,615,544 | B1 * | 9/2003 | Tlemcani et al. | 49/7 |

FOREIGN PATENT DOCUMENTS

| | | |
|---|---|---|
| DE | 19653503 A1 | 6/1998 |
| EP | 1281418 | 7/2002 |
| EP | 1 470 840 A1 | 10/2004 |
| ES | 2117921 | 8/1998 |
| FR | 2494347 | 5/1982 |
| GB | 341548 | 1/1937 |
| GB | 2275491 | 8/1994 |
| GB | 2289497 | 11/1995 |
| WO | WO 02/06616 A1 | 1/2002 |

OTHER PUBLICATIONS

German Search Report, Jul. 19, 2006.

* cited by examiner

*Primary Examiner* — Carlos Lugo
*Assistant Examiner* — Alyson M Merlino
(74) *Attorney, Agent, or Firm* — Baker & Hostetler LLP

(57) ABSTRACT

The invention relates to the use of an intumescent material as a sensor, actuator, or fixing means for movable elements in the field of fire and smoke protection.

6 Claims, 4 Drawing Sheets

USE OF AN INTUMESCENT MATERIAL AND DEVICE HAVING A MATERIAL OF THIS TYPE

CROSS REFERENCE TO RELATED APPLICATIONS

This application is a National Stage of Patent Cooperation Treaty (PCT) Application No. PCT/EP2004/011306, filed Oct. 8, 2004, entitled, USE OF AN INTUMESCENT MATERIAL AND DEVICE COMPRISING SUCH A MATERIAL, which claims priority to German Patent Application No. DE 10347027.1, filed Oct. 9, 2003, all of the disclosure both of which are hereby incorporated by reference in their entirety.

FIELD OF THE INVENTION

The present invention relates to the use of an intumescent material and devices having a material of this type.

BACKGROUND OF THE INVENTION

Intumescent material is known in principle in the field of fire protection from DE 19653503 A1, for example. This is a flexible insulating layer producer, based on expanded graphite, for example, which expands under the effect of temperature. It is offered as a roll material, as prepared strips, blanks, or stamped parts for use for fire protection doors, fire protection glass, facades, safes, cable and pipeline bushings, etc. In the following, it is referred to in short as intumescent material or simply as material.

Commercially available material is between 1.5 and 6.5 mm thick. Typical reaction temperatures are above 170° C. The foaming behavior is three-dimensional, the foam height being able to increase with increasing temperature at very high expansion pressure up to 45 times the starting volume. The expansion pressure is at least 0.8 $N/mm^2$. The known applications are exhausted in sealing and/or covering passages, gaps, and slots, as well as walls, with a protective layer in case of fire. For example, in fire protection doors, the material is glued to the door frames.

SUMMARY OF THE INVENTION

The present invention is based on the object of further improving devices in connection with fire alarms, fire prevention, personal protection, and asset protection for use in case of fire hazard.

This object is alternatively achieved via the following uses and devices. In this case, for all uses and devices, by predefining the expansion temperature, the reaction temperature may be set, the expansion temperature in turn being a function of the components of the material used. An adaptation to the intended purpose may thus be performed.

A first achievement of the object is the use of an intumescent material as a sensor for a fire alarm. The temperature-dependent expansion of the material is the criterion that a fire has broken out in this case.

A second achievement of the object is the use of an intumescent material as the actuator of a fire alarm. The material triggers a switch upon expansion, which in turn triggers an alarm signal.

A preferred refinement of the second achievement of the object is that the fire protection device is a door opener or a lock, and the intumescent material is operatively linked to at least one of the door opener components of armature, changeover switch, or latch or one of the lock components of latch, handle socket, bolt, or bolt drive. This has the advantage that movable parts relevant for the door opener function or lock function may have intumescent material applied to them directly, so that a predefined state may be reliably assumed or maintained in case of fire.

The security of fire protection doors may be significantly increased using the present invention. Fire protection doors are known to have the object of separating two fire sections. They fire protection door must therefore be safely and reliably "closed" in case of fire, but may not be locked. Furthermore, it is to be considered that large forces may act on the restraint due to high temperatures acting on one side. The present invention counters the danger that in case of fire the door opener or the lock opens due to electronic malfunction or due to burning out, deformation as a result of heat, etc.

Specifically, the present invention prevents the armature from being able to be deflected for indirect or direct release of the pivoting latch in a door opener. A door opener is especially safe if the changeover switch and/or the pivoting latch itself may additionally or alternatively have intumescent material applied to it. This advantage particularly applies if the armature or the changeover switch releases the changeover switch against gravity. Due to the effect of heat, the armature spring may burn out and the armature may thus release the changeover switch under the effect of gravity.

The advantages of the present invention apply in particular where electromechanically actuated elements or elements driven by a motor are activated by an electronic controller. This controller may break down in case of fire, while the activation voltage of the motor or the electromechanical actuation is still maintained and thus results in an actuation or drive of the element. The intumescent material moves the locking element against the electromechanical actuators here.

A third achievement of the object is the use of an intumescent material as a status documentation means of a current status of an element or a device in case of fire. Status documentation devices of this type are required, for example, for ascertaining the cause of fire in a device or building. For this purpose, for example, the status of display elements, actuating elements, etc. is to be fixed in the position in which the fire has broken out. The situation existing upon fire outbreak is more or less "frozen".

An expedient refinement of the fourth achievement of the object is that the element whose status is to be documented in case of fire is at least partially covered or completely enclosed by intumescent material through the effect of heat. This has the advantage that multiple parts of a device may be protected from the fire for later evaluation.

A fifth achievement of the object is an adjustment device in case of a fire having at least two elements, whose relative position is adjustable to one another, in that an intumescent material is operatively linked to at least one of the element in such a way that the intumescent material changes the relative position through its shape change. A fire sensor or a fire alarm may thus be produced in a simple way.

A sixth achievement of the object comprises a fixing device having at least two elements, whose relative position to one another is adjustable, in that an intumescent material is operatively linked to at least one of the elements in such a way that the intumescent material fixes the relative position through its shape change. Using a device of this type, for example, mechanical access control devices, such as door openers, locks, retaining devices, etc., may be equipped in such a way that they assume a predefined state in case of fire. Depending on the application, it may be desirable for an access to be closed or a door or a window to be released.

A preferred refinement of the sixth solution is that two elements adjustable in relation to one another are provided, one element being adjustable and the other element being fixed in place.

A seventh achievement of the object exists in a door or a window having at least one bolt, in that an intumescent material is operatively linked to the bolt in such a way that the intumescent material fixes the bolt in its current position through its shape change.

An eighth achievement of the object exists in a lock/release device for use in a door or a window having at least one bolt, in that an intumescent material is operatively linked to the bolt in such a way that the intumescent material moves the bolt into a predefined position (lock or release) through its shape change.

A ninth achievement of the object exists in an immobilizing system for fire protection and smoke protection doors as well as fire protection and smoke protection windows, fire protection flaps, or smoke dispersal flaps, in which the intumescent material actuates or triggers an immobilizing mechanism.

A tenth achievement of the object exists in a lock/release device for use in a door opener, in general at least one armature and one latch being provided as elements adjustable in relation to one another, in that an intumescent material is positioned in such a way that its shape change changes and/or fixes the relative position of at least one adjustable element, and thus brings the door opener into a predefined position and/or keeps it in a predefined position.

A preferred refinement of the tenth achievement of the object is that the predefined position is a lock or release position.

Furthermore, is expedient for this purpose for the intumescent material to be positioned at a rotation point of the adjustable element in the starting state.

Moreover, it may be advantageous for the intumescent material to be positioned at a free end of the adjustable element in the starting state.

The intumescent material is advantageously positioned within a device housing to fill up the free space in the starting state.

In principle, the intumescent material may be positioned on a movable part. However, it has been shown to be expedient for the intumescent material to be positioned on a housing wall as the position-fixed element in proximity to the adjustable element in the starting state.

It is advantageous for the intumescent material to be positioned in a recess of the housing wall in the starting state, because it may be easily attached reliably there, by gluing or clamping, for example.

BRIEF DESCRIPTION OF THE DRAWINGS

In the following, the present invention will be described further on the basis of two exemplary embodiments illustrated in the drawing.

DETAILED DESCRIPTION OF THE INVENTION

Figure 1A:
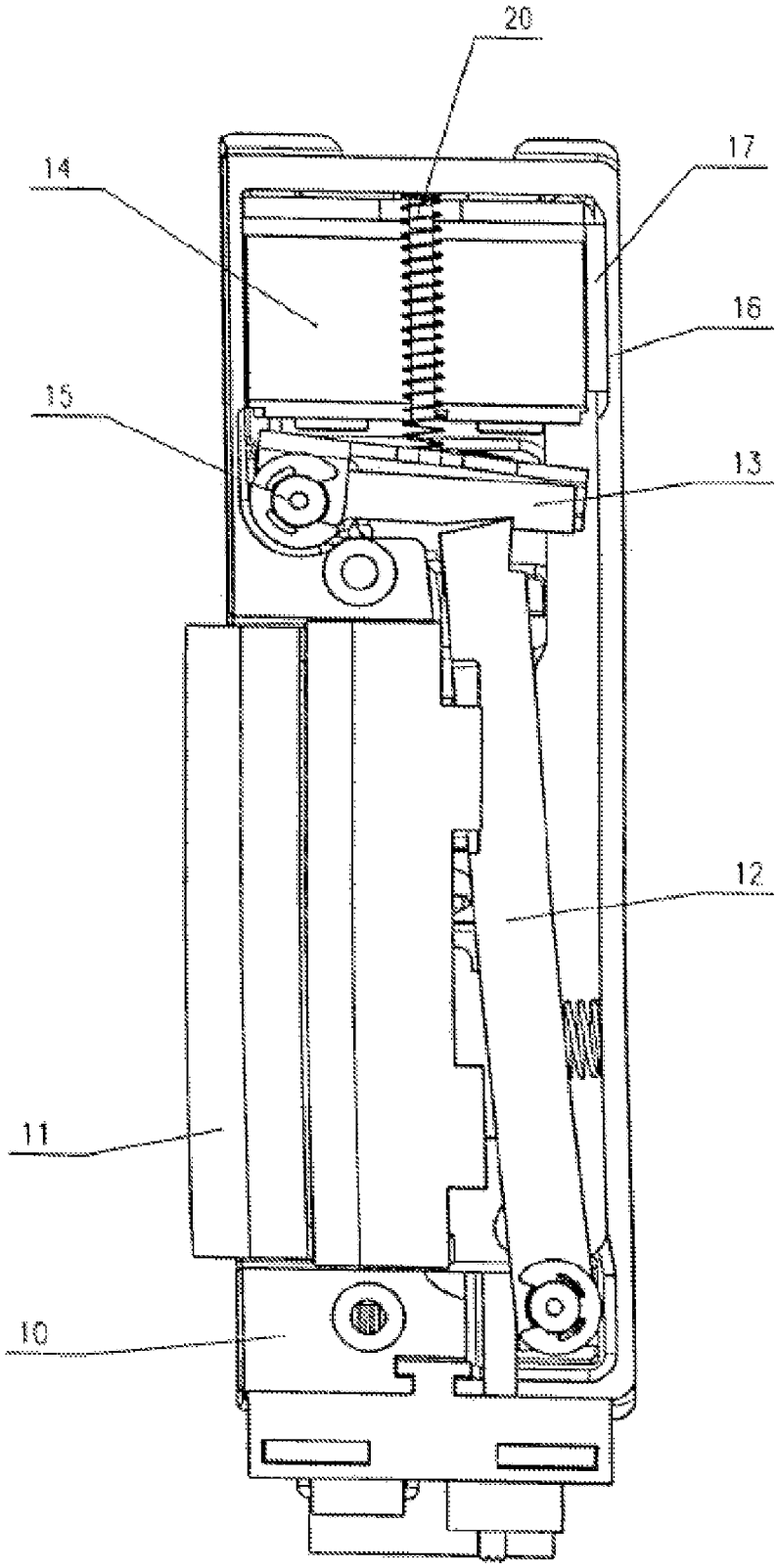
FIG. 1A and FIG. 2A each schematically show a_cross section through a door opener, while FIGS. 1B and 2B each schematically show a cross section through a door opener with the intumescent material in an expanded state.

As shown in FIG. 1A, a door opener in a housing 10 has a pivot latch 11, a changeover switch 12, and an armature 13, implemented as a changeover lock, having a coil 14 of an electromagnet. The armature 13 is implemented as a pivot lever on a joint 15 and is pre-tensioned using an armature spring 20 in such a way that it is held in its locking position, which is shown in the figure. When current is applied to the coil 14, the armature 13 is pulled into its unlocking position against the spring action, so that the changeover switch 12 releases the pivot latch 11.

An intumescent material 17 is positioned in a recess 16 on an inner wall of the housing 10 in proximity to the armature 13 in such a way that it fills up the free space of the housing in the area of the armature 13 through its volume expansion, and permanently embeds the armature 13 in the locking position at the same time. In the example shown, the intumescent material 17 is positioned in the area of the free end of the armature 13, so that the expansion pressure acts on the long lever arm of the armature 13. The intumescent material 17 is glued to the housing wall.

Figure 1B:
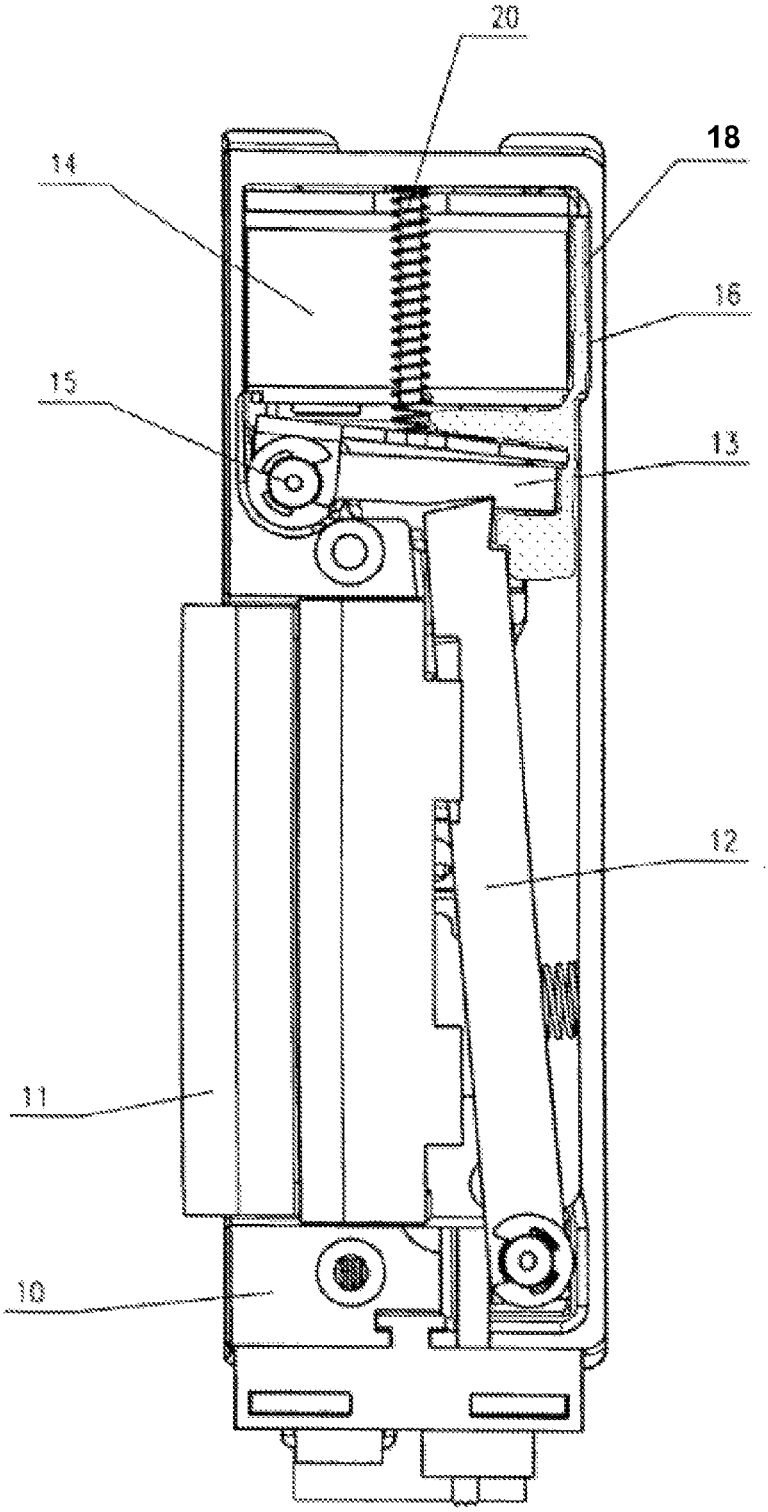

In case of fire, when the expansion temperature has been reached and the intumescent material expands, the expanded intumescent material 18 presses against the armature 13 and holds it in its locking position independently of the action of the armature spring 20, as depicted in FIG. 1B. The pivot latch 11 therefore remains locked, even if the armature spring 20 burns out. The armature is more or less "frozen" in the locking position. This is true even if the door opener is installed rotated by 180° and the armature spring 20 presses the armature 13 into the locking position against its own weight.

Figure 2A:
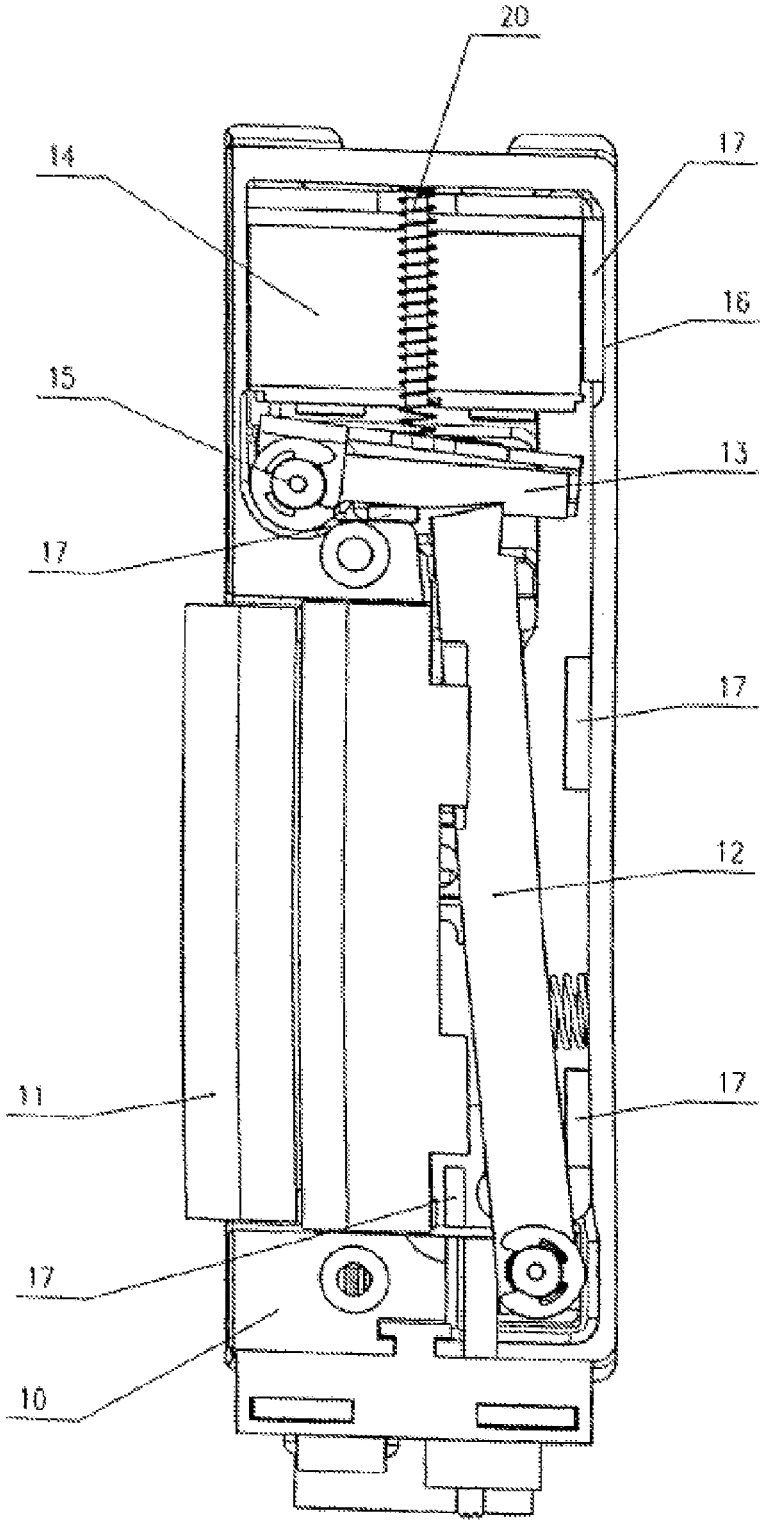
Figure 2B:
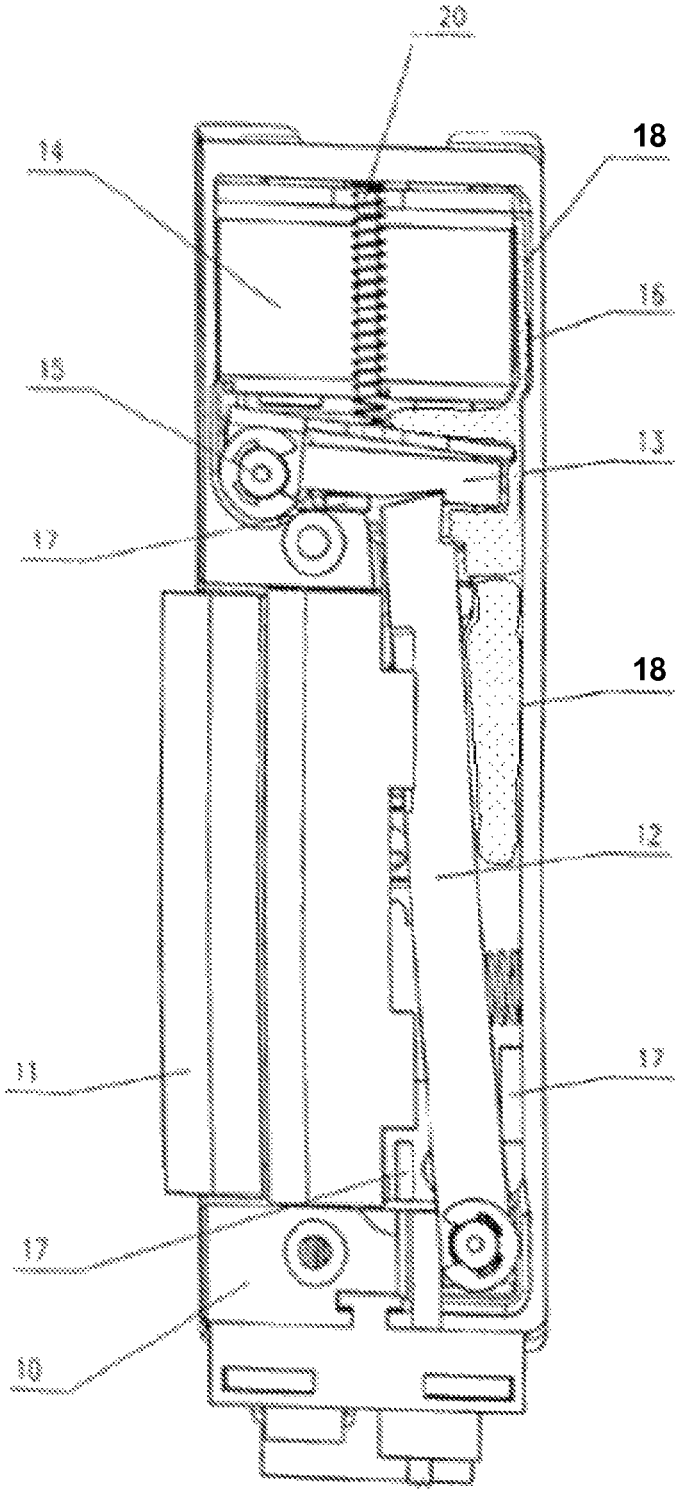

In the exemplary embodiment of a further door opener shown in FIG. 2A, identical parts as in FIG. 1A are provided with identical reference numbers. In addition, additional arrangements 17 of intumescent material are provided in further free spaces inside the housing 10, particularly in the area of the movable parts, such as pivot latch 11 and changeover switch 12. Under the effect of heat, they fill up the free spaces and block the movement of the affected parts. The door opener is thus additionally secured against opening. FIG. 2B depicts expanded intumescent material 18 in the upper region of the door opener; the intumescent material 17 in the lower region of the door opener expands in a similar manner (not depicted for clarity).

The invention claimed is:

1. A door opener, comprising:

a housing with an inner wall;

a pivot latch;

a changeover switch;

an armature;

an intumescent material, having an expansion temperature, positioned on the inner wall of the housing proximate to the armature; and a plurality of free spaces disposed between the inner wall and the pivot latch, the inner wall and the changeover switch, and the inner wall and the armature, wherein the intumescent material volumetrically expands into the free space between the inner wall and the armature and permanently embeds the armature in a locking position when the expansion temperature has been reached.

2. A door opener according to claim 1, wherein the armature is implemented as a pivot lever on a joint and is pre-tensioned using an armature spring in such a way that the armature is held in a locking position, and wherein the expanded intumescent material presses against the armature and holds the armature in the locking position independently of the action of the armature spring.

3. A door opener according to claim 2, wherein the intumescent material is positioned so that the expansion pressure acts on the pivot lever of the armature.

4. A door opener according to claim 1, further comprising additional intumescent material positioned on the inner wall proximate to the pivot latch and the changeover switch, wherein the additional intumescent material volumetrically expands into the free spaces between the inner wall and the pivot latch, and the inner wall and the changeover switch, and blocks the movement of the pivot latch and the changeover switch when the expansion temperature has been reached.

5. A door opener according to claim 1, wherein the intumescent material is glued to the housing wall.

6. A door opener according to claim 1, wherein the inner wall includes a recess and the intumescent material is positioned in the recess.

* * * * *